US009511386B2

(12) United States Patent
Kuroda et al.

(10) Patent No.: US 9,511,386 B2
(45) Date of Patent: Dec. 6, 2016

(54) COATING SYSTEM AND COATING METHOD

(71) Applicant: CANON KABUSHIKI KAISHA, Tokyo (JP)

(72) Inventors: Kazuo Kuroda, Kamakura (JP); Hiroaki Iwai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/156,796

(22) Filed: Jan. 16, 2014

(65) Prior Publication Data

US 2014/0205760 A1 Jul. 24, 2014

(30) Foreign Application Priority Data

Jan. 22, 2013 (JP) ..... 2013-009292

(51) Int. Cl.
*B05B 12/04* (2006.01)
*B05B 13/02* (2006.01)
(Continued)

(52) U.S. Cl.
CPC ..... *B05B 12/04* (2013.01); *B05B 13/0221* (2013.01); *B05B 13/0228* (2013.01);
(Continued)

(58) Field of Classification Search
USPC ..... 901/43; 118/696
See application file for complete search history.

(56) References Cited

U.S. PATENT DOCUMENTS 5,757,498 A * 5/1998 Klein et al. ..... 356/630
2009/0185196 A1 7/2009 Bang et al.
(Continued)

FOREIGN PATENT DOCUMENTS

CN 101493316 A 7/2009
CN 102614565 A 8/2012
(Continued)

OTHER PUBLICATIONS

Office Action in Chinese Patent Application No. 201410022813.0, dated Sep. 28, 2015.
(Continued)

*Primary Examiner* — Nathan T Leong
(74) *Attorney, Agent, or Firm* — Fitzpatrick, Cella, Harper & Scinto

(57) ABSTRACT

A coating system comprises: a coating apparatus connected to a syringe filled with a coating agent and having a nozzle for discharging the coating agent of the connected syringe; a robot which moves an object to be coated, held by a robot hand, to a coating position; and a control unit, wherein the coating apparatus comprises a plurality of syringes respectively filled with different coating agents, the nozzles connected to the respective syringes, and a rotary table for rotationally moving together the syringes and the connected nozzles, and the control unit controls to select the syringe filled with the coating agent to be applied to the object, move the nozzle connected to the selected syringe to a position facing the coating position by the rotation of the rotary table, move the object held by the robot hand to the coating position, and discharge the coating agent from the nozzle.

17 Claims, 6 Drawing Sheets

(51) Int. Cl.
*B05B 15/02* (2006.01)
*B05B 15/08* (2006.01)

(52) U.S. Cl.
CPC ..... *B05B 15/025* (2013.01); *B05B 15/08* (2013.01); *Y10S 901/43* (2013.01)

(56) References Cited

U.S. PATENT DOCUMENTS

| | | | | |
|---|---|---|---|---|
| 2010/0245466 | A1* | 9/2010 | Inoue | 347/30 |
| 2011/0204102 | A1* | 8/2011 | Suhara | 222/566 |

FOREIGN PATENT DOCUMENTS

| | | | |
|---|---|---|---|
| JP | 61-122086 | A | 6/1986 |
| JP | 63-178582 | A | 7/1988 |
| JP | 2-303570 | A | 12/1990 |
| JP | 6-209154 | A | 7/1994 |
| JP | 2001-349086 | A | 12/2001 |
| JP | 2002-198304 | A | 7/2002 |
| JP | 2006-081955 | A | 3/2006 |

OTHER PUBLICATIONS

Office Action mailed Oct. 4, 2016, in Japanese Patent Application No. 2013-009292.

* cited by examiner

MEASURING ROUGH NEEDLE CENTER POSITION BY RECIPROCATING NOZZLE AT FIRST INTERSECTION (MEASUREMENT OF $\theta 1$)

MEASURING POSITION IN Z DIRECTION BY LIFTING NEEDLE TIP POSITION DETECTING APPARATUS UP

MEASURING POSITIONS IN X AND Y DIRECTIONS BY RECIPROCATING NOZZLE AT ANOTHER INTERSECTION (MEASUREMENT OF $\theta 2$)

COATING SYSTEM AND COATING METHOD

BACKGROUND OF THE INVENTION

Field of the Invention

The present invention relates to a robot cell apparatus which performs assembly work or the like using a robot and a production system which is equipped with the plurality of robot cell apparatuses, and more particularly to a coating system and a coating method which perform coating to parts.

Description of the Related Art

Conventionally, many kinds of assembly apparatuses each using a robot have been widely used. In recent years, an assembly apparatus which is able to achieve, by a robot, assembly work formerly performed by man power has been required. In the assembly work by man power, a human cell production system in which a conveyor is eliminated and work is directly carried by a person has been introduced. Under the circumstances, to replace such a human cell with a robot cell, an assembly system which is able to grasp various parts and perform assembly work has been required.

In the robot cell, there is a case where it is necessary to coat parts with grease, sealant or the like. Consequently, as well as the human cell, it is necessary in one robot cell to apply a plurality of kinds of coating agents respectively to one part (or one component) at accurate positions and with accurate amounts. Particularly, in coating work for precision parts, accurate control with a micrometer unit is necessary.

Conventionally, as a coating system which performs, by using a robot, coating to an object to be coated, the coating system which moves the robot having the coating apparatus to the position at which the object to be coated exists and then performs the coating to the object to be coated is known (Japanese Patent Application Laid-Open No. S61-122086). Also, the coating system which conversely moves, by the robot, the object to be coated to the position of the fixed coating apparatus and then performs the coating to the object to be coated is known (Japanese Patent Application Laid-Open No. 2006-081955).

However, in the above conventional coating system, there are following drawbacks in a case where the plurality of coating agents are applied to the one part only by the one robot cell.

Firstly, in the coating system disclosed in Japanese Patent Application Laid-Open No. S61-122086, since the plurality of robots corresponding to the number of kinds of coating agents are necessary, a large space for holding them is necessary. In addition, a takt time is prolonged.

Secondly, in the coating system disclosed in Japanese Patent Application Laid-Open No. 2006-081955, when a user intends to apply many kinds of coating agents to the object to be coated, it is necessary to arrange many coating apparatuses and move the object to be coated among the arranged coating apparatuses by the robot, whereby the problem same as above arises.

The present invention has been completed in consideration of the above problems, and an object thereof is to achieve, in a coating system, shortening of a takt time and space saving even in case of applying a plurality of kinds of coating agents to a plurality of portions of one object to be coated.

SUMMARY OF THE INVENTION

To solve the above problem, according to a first aspect of the present invention, there is provided a coating system which comprises: a coating apparatus, connected to a syringe filled with a coating agent, having a nozzle configured to discharge the coating agent of the connected syringe; a robot configured to move an object to be coated, held by a robot hand, to a coating position; and a control unit configured to control the coating apparatus and the robot, wherein the coating apparatus comprises the plurality of syringes respectively filled with the different coating agents, the nozzles connected to the respective syringes, and a rotary table for rotationally moving together the plurality of syringes and the nozzles connected to the respective syringes, and wherein the control unit performs control for selecting the syringe filled with the coating agent to be applied to the object to be coated, and moving the nozzle connected to the selected syringe to a position facing the coating position by the rotation of the rotary table, performs control for moving the object to be coated held by the robot hand to the coating position, and performs control for discharging the coating agent from the nozzle.

Moreover, according to a second aspect of the present invention, there is provided a coating method which uses a coating apparatus, connected to a syringe filled with a coating agent, having a nozzle configured to discharge the coating agent of the connected syringe, and a robot configured to move an object to be coated, held by a robot hand, to a coating position, wherein the coating apparatus is configured to comprise the plurality of syringes respectively filled with the different coating agents, the nozzles connected to the respective syringes, and a rotary table for rotationally moving together the plurality of syringes and the nozzles connected to the respective syringes, and wherein, before, after or concurrently with a syringe selection step of selecting the syringe filled with the coating agent to be applied to the object to be coated, and moving the nozzle connected to the selected syringe to a position facing the coating position by the rotation of the rotary table, an object to be coated moving step of moving the object to be coated held by the robot hand to the coating position is performed, and after then a coating step of applying the coating agent to the object to be coated by discharging the coating agent from the nozzle connected to the syringe selected in the syringe selection step is performed.

Further features of the present invention will become apparent from the following description of exemplary embodiments with reference to the attached drawings.

BRIEF DESCRIPTION OF THE DRAWINGS

FIG. 4A is the plan view illustrating the rotary table, a nozzle and a pair of tip position determining units, FIG. 4B is the side view illustrating the syringe, the nozzle and the pair of tip position determining units, and FIG. 4C is the plan view illustrating the rotary table, the nozzle and another pair of tip position determining units.

DESCRIPTION OF THE EMBODIMENTS

Figure 1:
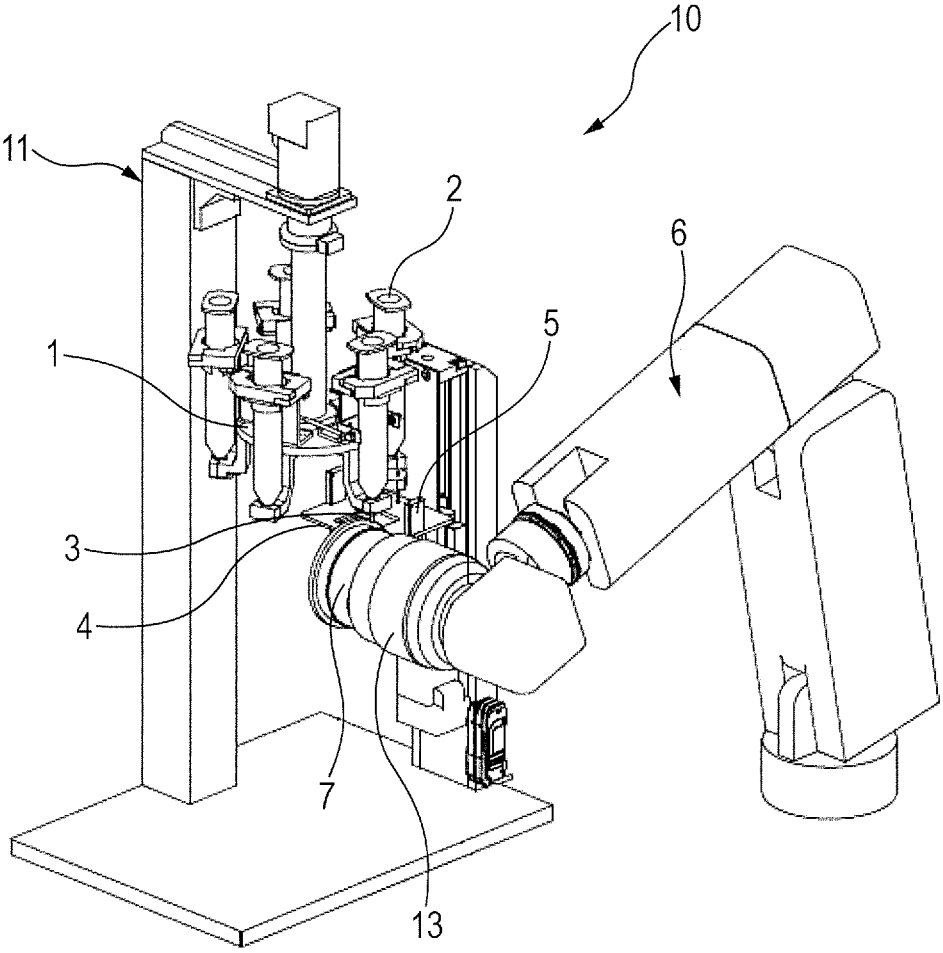
FIG. 1 is a schematic diagram illustrating a coating system according to the present invention.

Hereinafter, preferred embodiments of the present invention will be described in detail in accordance with the accompanying drawings. However, it should be noted that the present invention is not limited to the following embodiments. Incidentally, as to portions not illustrated or described particularly in this application, a publicly or generally known technique in the related technical field is applied. Moreover, in the drawings to be referred hereinafter, same numbers and symbols indicate same constituent elements respectively.

First, the constitution of a coating system according to the present invention will be described with reference to FIGS. 1 to 3.

A coating system 10 according to the present invention has a coating apparatus 11 and a robot 6. In this embodiment, an actuator is formed as a motor type and an encoder is connected to the actuator to constitute that as to each of control positions, angles and the like, information from the encoder is stored. However, as for the coating system 10 of the present invention, a type of the actuator is not limited, and further, a means other than the encoder can be utilized as a means of obtaining information.

The coating apparatus 11 has a rotary table 1 arranged capable of rotating around a vertical rotation axis and a plurality of syringes 2 filled with different coating agents respectively held downward to the rotary table 1. Nozzles 3 used for discharging the coating agents filled in the respective syringes 2 are respectively connected downward to lower parts of the respective syringes 2, and the syringes 2 are rotationally moved together with the nozzles 3 by the rotation of the rotary table 1.

As illustrated in FIG. 1, the five syringes 2, to which the nozzles 3 are respectively connected, are held to the rotary table 1 in the present embodiment. The syringes 2 are held downward to the rotary table 1 and the nozzles 3 are connected downward to lower parts of the syringes 2. In the present embodiment, the different coating agents are respectively filled in the four syringes 2 among these five syringes 2. The one remaining syringe 2 is used for the teaching and the nozzle 3 connected to this one syringe 2 is also used for the teaching. As the coating agents, for example, a UV hardening adhesive, an adhesive, grease, a screw locking glue and the like can be enumerated.

A cleaning unit 4 and two pairs of tip position determining units 5 and 5 used for determining tip positions of the nozzles 3 are provided at a lower part of the rotary table 1. The two pairs of tip position determining units 5 and 5 in this example are respectively constituted by thru-beam type sensors.

A robot 6, which is an articulated robot, has a robot hand 13 at one part. As the articulated robot, a six-axis articulated robot can be used. The robot hand 13 has such the structure capable of holding an object 7 to be coated regarded as an object targeted to be coated. As a holding method, a method of grip or absorption can be used.

Figure 2:
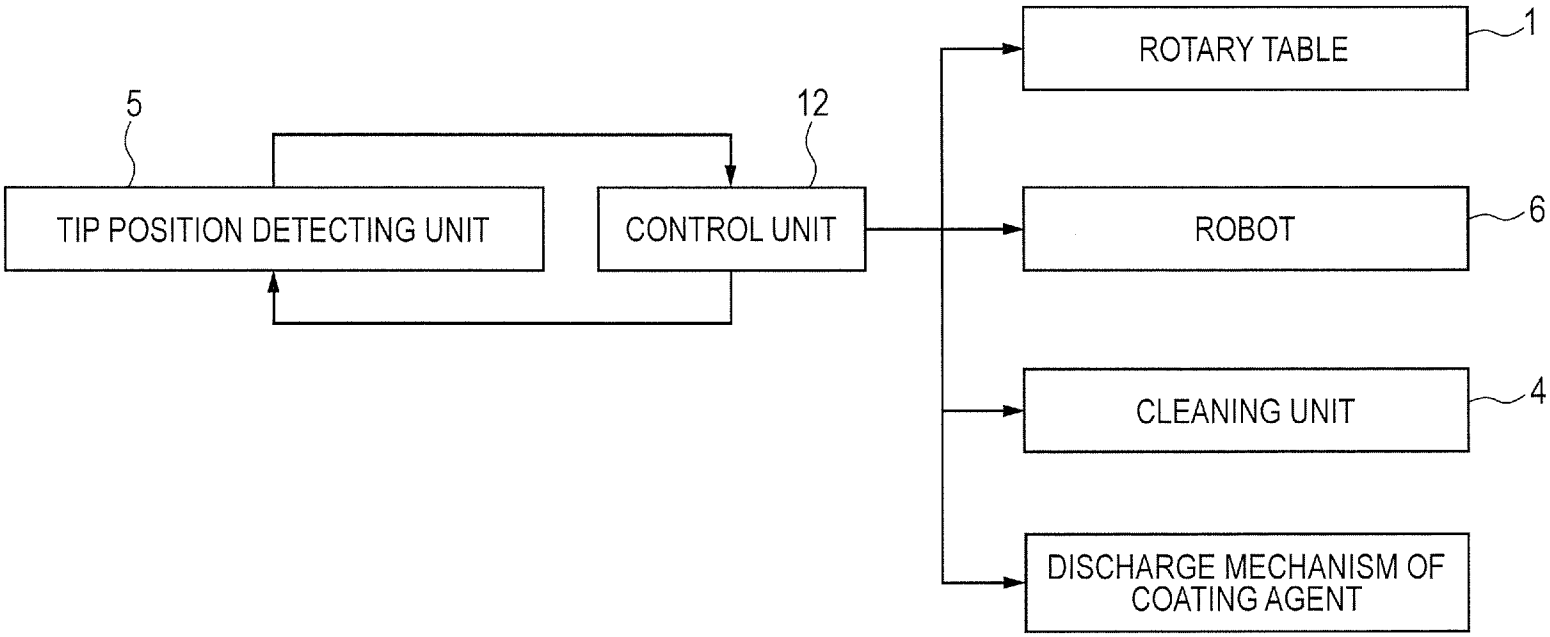
FIG. 2 is a control conceptual diagram of the coating system according to the present invention.
Figure 3:
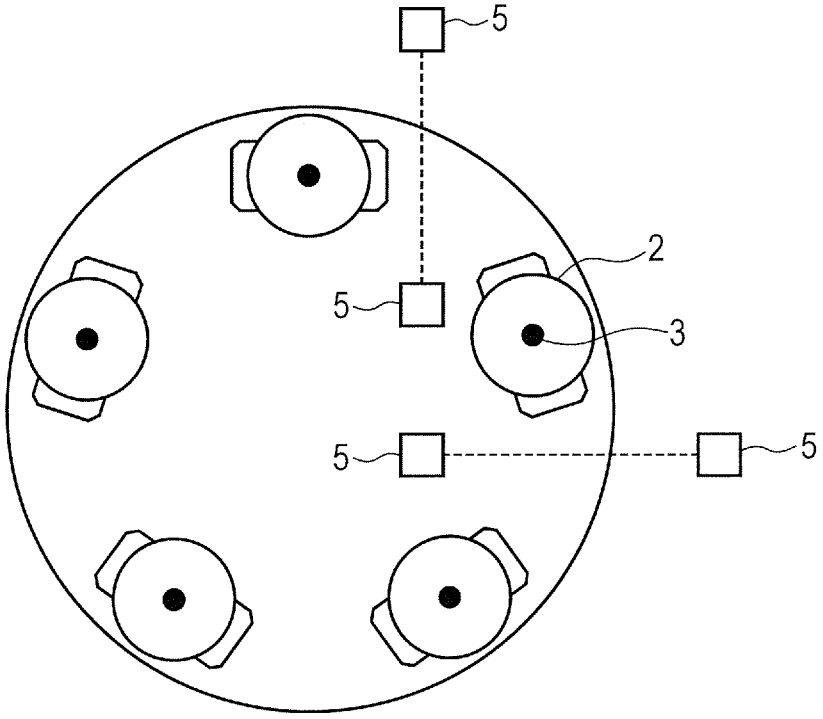
FIG. 3 is a schematic diagram obtained by viewing a lower part of a rotary table illustrated in FIG. 1 from a lower side.

The coating system 10 according to the present invention has a control unit 12 as indicated in FIG. 2. The control unit 12 controls the tip position determining units 5 and 5 and also controls operations of the rotary table 1, the robot hand 13, the cleaning unit 4 and a discharge mechanism of the coating agent while referring to a determination result obtained by the tip position determining units 5 and 5.

A coating method of the present invention will be described together with a procedure of a coating operation performed by the coating system 10 according to the present invention.

First, a command is output from the control unit 12 as indicated in FIG. 2, and the nozzle 3 used for the teaching is moved to a place opposite to a coating position by rotating the rotary table 1. The coating position is a position of the object 7 to be coated which should be positioned when performing the coating by using the coating agent discharged from the nozzle 3 connected to the selected syringe 2. Although the coating position can be arbitrarily selected among positions to which the nozzle 3 can be oppositely located, it is generally preferable to select such a position to which the robot 6 can be easily accessed. In the present embodiment, the coating position is selected among positions just under the nozzle 3 which rotationally moved in response to the rotation of the rotary table 1. The coating position is previously set and stored in the control unit 12.

The teaching for the robot 6 generally also called as a robot teaching is performed by using the nozzle used for the teaching. The teachings are performed plural times, of which the number is identical with the number of the coating portions. For example, in case of applying the four coating agents to four portions of the object 7 to be coated as in this embodiment, the teachings of the four portions to be coated are performed. The teaching contents are the setting of coating positions, the setting of places opposite to the coating positions, the setting of a position of the object 7 to be coated when performing the coating and the like. Although it will be described later in detail, the teachings of a plurality of coating portions are performed for the object 7 to be coated by the one nozzle 3 used for the teaching. When the coating is actually performed, the object 7 to be coated is moved to the coating position by the robot 6 while correcting the coating position by the misalignment amount for the relevant nozzle 3 used for the coating.

Generally, the teachings for the robot 6 and the coating apparatus 11 are not frequently performed but performed when the apparatus is located and moved or after the maintenance performed after a long-term stop.

When the teaching is completed, the determination of a tip position is performed as to the nozzle 3 used for the teaching. Thereafter, the determination of tip positions of the nozzles 3 is performed as to the syringes 2 to which the nozzles 3 used for the discharge other than the nozzle 3 used for the teaching are attached, and the position differences $\Delta X$, $\Delta Y$ and $\Delta Z$ between the tip of the nozzle 3 used for the teaching and the tips of the other nozzles 3 are calculated for the respective other nozzles 3, and information thereof is accumulated in the control unit 12 indicated in FIG. 2. Note that the $\Delta X$ and $\Delta Y$ denote misalignment amounts in the X-axis direction and the Y-axis direction which are two directions orthogonally intersected each other set on a plane orthogonally intersected with a rotation axis of the rotary table 1, and the $\Delta Z$ denotes a misalignment amount in the Z-axis direction which is the rotation axis direction of the rotary table 1. The above-described misalignment amounts are fed back to the robot 6 and the coating is performed after correcting a position of the object 7 to be coated by the robot 6, thereby realizing to perform the high-precision coating.

The above-described description corresponds to a preparation before operating the coating system 10. It is preferable to perform the tip position determination of the nozzles 3 used for the coating and the nozzle 3 used for the teaching respectively one time a day before operating the system. A specific method of determining the tip positions will be described later.

Next, a coating operation will be described.

A control of moving the nozzles 3, which are connected to the syringes 2 filled with the coating agents to be coated, to positions opposite to the coating positions by rotating the rotary table 1 is included in the control unit 12 of the coating system 10 according to the present invention. In addition, a control of moving the object 7 to be coated held by the robot hand 13 of the robot 6 to the coating position and a control of performing the coating by discharging the coating agent filled in the selected syringe 2 from the nozzle 3 are also included in the control unit 12.

First, the syringe 2 filled with the coating agent necessary for the coating of first time is selected, and the nozzle 3 connected to this selected syringe 2 is moved to a position opposite to the coating position by rotating the rotary table 1 (syringe selection process). Next, the object 7 to be coated held by the robot hand 13 of the robot 6 is moved to the coating position, and a portion desired to be coated is held with such a position to be faced to the direction of the nozzle 3 in accordance with necessity (a process of moving an object to be coated). In case of moving the object 7 to be coated, the difference between the tip position of the nozzle 3 used for the teaching previously obtained and the tip position of the nozzle 3 selected to perform the coating actually is fed back from the control unit 12 to the robot 6. The robot 6 corrects the position by the fed back data and moves the object 7 to be coated such that a coating portion of the object 7 to be coated becomes a position just under the nozzle 3.

In the above-described description, a control of moving the object 7 to be coated to the coating position is performed after a control of moving the nozzle 3 connected to the selected syringe 2 to a position opposite to the coating position. However, the control of moving the object 7 to be coated to the coating position can be also simultaneously performed with or previously performed to the control of moving the above-described nozzle 3. That is, the syringe selection process and the process of moving an object to be coated may be simultaneously performed or either process may be performed before or after. A takt time can be shortened by a method that the syringe selection process and the process of moving an object to be coated are simultaneously performed.

The coating process of applying the coating agent is performed after the above-described syringe selection process and the process of moving an object to be coated. A process of applying the coating agent is performed by discharging the coating agent from the nozzle 3. The robot hand 13 can change a position of the object 7 to be coated with a state that the object 7 to be coated was moved to the coating position. A coating operation can be performed to a necessary region by a process that a position of the object 7 to be coated is changed by moving it by the robot hand 13 in the course of discharging the coating agent. For example, in FIG. 1, a coating operation is performed in linear form on an outer circumference of the object 7 to be coated having a cylindrical shape. Specifically, the coating operation is performed on a cylindrical surface of the object 7 to be coated by discharging the coating agent from the nozzle 3 during a period when the object 7 to be coated is rotated by the robot hand 13. A timing of the discharging operation, a motion of the robot 6, a correction of a coating position and the like are controlled by the control unit 12.

When a first coating operation of applying the coating agent is completed by the method as in the above description, the rotary table 1 is rotated such that the nozzle 3 positions just above the cleaning unit 4 in order to clean the nozzle 3 which discharged the coating agent just before. The cleaning unit 4, which can move up and down in the rotation axis direction of the rotary table 1, moves upward toward the nozzle 3, which moved to just above the cleaning unit 4, to clean the nozzle 3. As to a cleaning operation, it will be described later in detail.

A position of the cleaning unit 4 can be determined by considering the interference with the robot 6, a takt time and the like. Generally, it is preferable to locate just under the nozzle 3 just after completing a discharging operation when the rotary table 1 is rotated about 90-degree from the coating position so that the takt time can be shortened without interfering with the robot 6 and the object 7 to be coated located near the coating position.

The above description corresponds to a series of operations from the teaching for the robot 6 to the cleaning of the nozzle 3 after discharging the coating agent in the coating system 10 according to the present invention.

Thereafter, when another coating agent is applied, the rotary table 1 is rotated by the control unit 12 such that the nozzle 3, which is connected to the syringe 2 filled with the coating agent to be applied next, is moved to a place opposite to the coating position. Then, a coating operation is performed to a previously taught coating portion of the object 7 to be coated by the above-described series of operations. As to the other coating agent, the same operation is also performed.

Next, a determination of a tip position of the nozzle 3 attached to the syringe 2 will be described.

Figure 5:
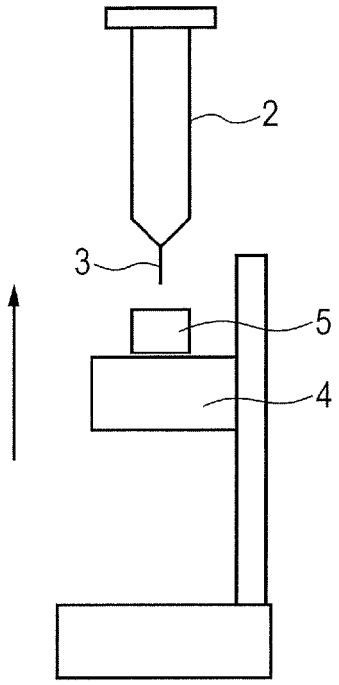
FIG. 5 is a schematic diagram obtained by laterally viewing a cleaning unit illustrated in FIG. 1.

The coating system 10 according to the present invention has the two pairs of tip position determining units 5 and 5 for determining a tip position of the nozzle 3. The pairs of tip position determining units 5 and 5 in the present embodiment, which respectively point the light axes to the direction orthogonally intersects with a rotary axis of the rotary table 1, are constituted by thru-beam type sensors located on different positions to the plane direction. The thru-beam type sensors have a projector and a photo-detector and act to determine a tip portion of the nozzle 3 which intersects the light axis between the projector and the photo-sensor. In the present embodiment, both the two pairs of tip position determining units 5 and 5 arranged on the cleaning unit 4 can move up and down as illustrated in FIG. 5.

First, in order to perform the determination, a tip position of the nozzle 3 to be determined is moved to a predetermined horizontal position, which can be determined by the one tip position determining unit 5, by rotating the rotary table 1 by the control unit 12. When it is completed to move the tip position of the nozzle 3, the tip position determining unit 5 is lifted by the control unit 12 to a position, where the tip position of the nozzle 3 is determined. A schematic diagram in this case is illustrated in FIG. 5. As to a horizontal position where the tip position of the nozzle 3 can be determined, the positioning is previously conducted when the teaching is performed or before that, and the related position information is stored in the control unit 12.

Figure 4A:
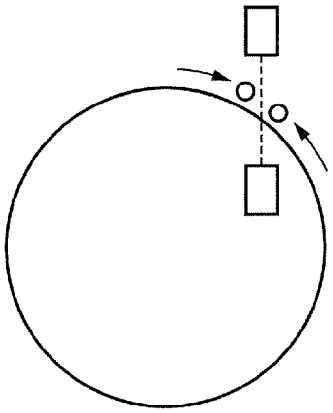
FIGS. 4A, 4B and 4C are explanatory views of a tip position determining unit in case of determining a tip position of a syringe, and specifically.
Figure 6:
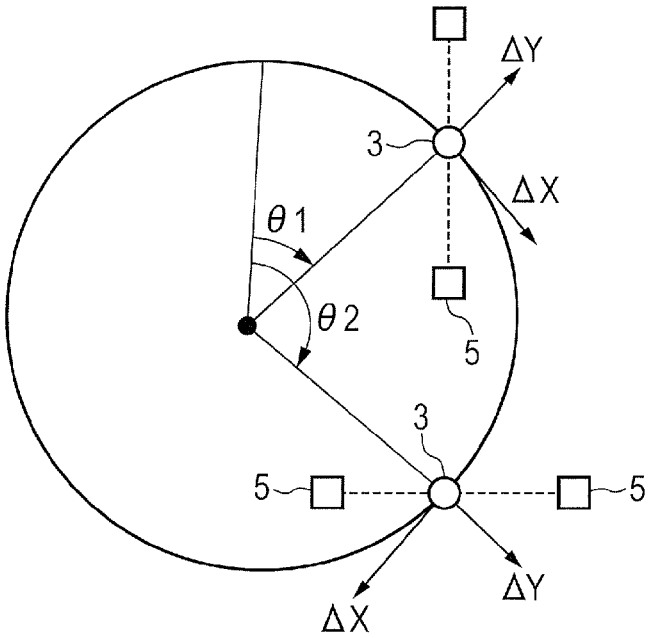
FIG. 6 is a diagram for describing each of parameters at a time of determination of a tip position of the nozzle by the tip position determining units.

Acquisition of the horizontal position, where the tip position of the nozzle 3 can be determined, will be further specifically described. As illustrated in FIG. 3 and FIGS. 4A to 4C, the rotary table 1 is rotated and then the nozzle 3 is moved in such a way as to intersect the light axis of the thru-beam type sensor which constitutes the tip position determining unit 5. At this time, since two pairs of the tip position determining unit 5 and 5 are horizontally arranged, although a tip of the nozzle 3 intersects the light axis by two portions, as to first one portion of these two portions, the tip of the nozzle 3 is clockwise and counterclockwise intersected two times in such a way as to reciprocate (FIG. 4A). This method aims to calculate a position at the intersection of the nozzle 3 with the light axis more accurately by calculating a middle point when the tip of the nozzle 3 intersects the light axis two times. At this time, the position at the intersection (a middle point in case of intersecting two times) of the light axis with the nozzle 3 is accumulated in the control unit 12 as rotation angle information of the rotary table 1. That is, a horizontal position, where the tip position of the nozzle 3 can be determined, can be specified as a position when the rotary table 1 rotates by θ1 from an arbitrarily set origin position of the rotary table 1. A value of this parameter θ1 is stored in the control unit 12 in order to use in the subsequent calculation. As to respective parameters, refer to FIG. 6.

Figure 4B:
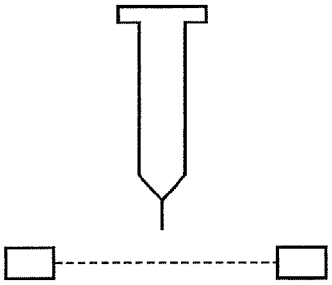

After obtaining the above-described θ1, the nozzle 3 is moved to such a position rotated by θ1 from an origin accumulated in the control unit 12 by rotating the rotary table 1. At this point, the tip position determining unit 5 is once dropped to a position, where the nozzle 3 does not intersect with the light axis of the tip position determining unit 5. Thereafter, the tip position determining unit 5 is lifted in the rotation axis direction (Z-axis direction) of the rotary table 1 to a position, where the tip of the nozzle 3 intersects with the light axis of the tip position determining unit 5 (FIG. 4B and FIG. 5). Position information of the Z-axis direction of the tip position determining unit 5 at that time is accumulated in the control unit 12. This position information becomes Z-position information of the nozzle 3.

Figure 4C:
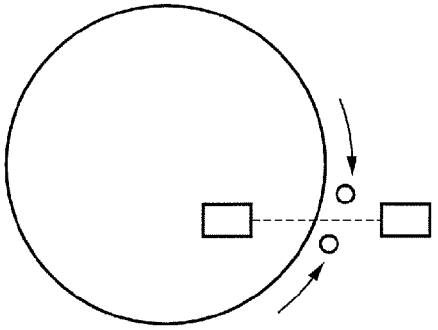

Next, the rotary table 1 is rotated, and the nozzle 3 is clockwise and counterclockwise intersected two times in such a way as to reciprocate at another one intersection of the nozzle 3 with the light axis as illustrated in FIG. 4C. The position (position of a middle point in case of intersecting two times) at an intersection of the nozzle 3 with the light axis of another one pair of the tip position determining unit 5 obtained by this second operation is accumulated in the control unit 12 similarly as rotation angle information θ2 from the origin position of the rotary table 1.

Information of θ1, θ2 and Z-position about the nozzle 3 can be obtained by this series of operations. Information indicating how much gap is observed between a tip of the taught nozzle 3 used for the teaching and a tip of the nozzle 3 used for the coating can be obtained as ΔX, ΔY and ΔZ by a process that these three parameters are compared with each other and geometrically calculated as to a plurality of nozzles 3.

Figure 7:
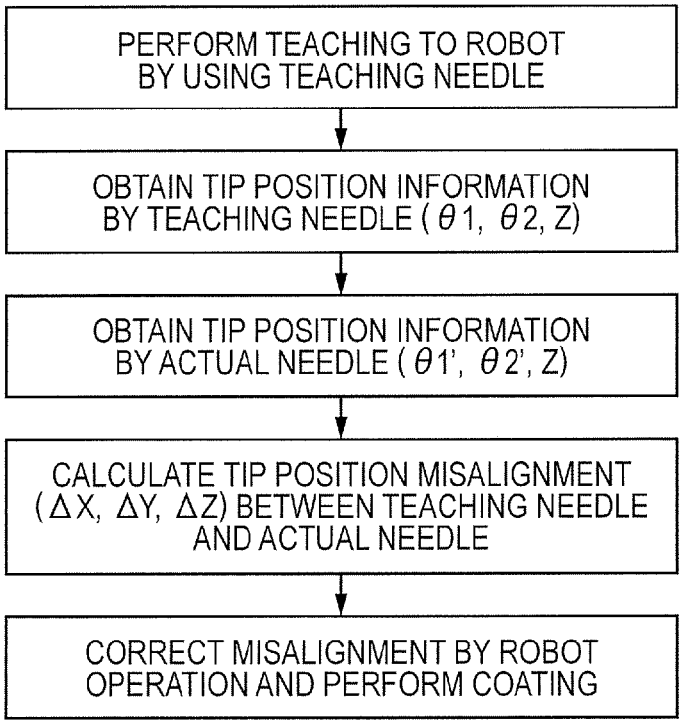
FIG. 7 is a flow chart indicating a process from teaching to coating performed by the coating system according to the present invention.

A series of operations from an actual teaching to an actual coating will be described with reference to FIG. 7.

First, the teaching is performed by using the nozzle 3 used for the teaching attached to some position on the rotary table 1. Next, information of θ1, θ2 and Z-position of the nozzle 3 used for the teaching is obtained by using the above-described method and accumulated in the control unit 12 in order to obtain position information of the nozzle 3 used for the teaching.

Next, information about a tip position of the nozzle 3 actually used for the coating attached to another position on the rotary table 1 is obtained as information of θ1', θ2' and Z'-position by using the above-described method and accumulated in the control unit 12.

Next, in the control unit 12, differences ΔX, ΔY and ΔZ between the tip positions of the nozzle 3 actually used for the coating and the nozzle 3 used for the teaching are calculated by using the six parameters obtained and accumulated by the above-described method and a rotation radius R of the nozzle 3 used for the teaching previously determined.

In case of performing the actual coating, information is transferred from the control unit 12 to the robot 6 such that the differences ΔX, ΔY and ΔZ previously calculated and accumulated in the control unit 12 are to be corrected, and the robot hand 13 moves the object to be coated from a teaching position, which was firstly taught, to a corrected position, and then the coating is performed.

The above-described procedure corresponds to a series of operations from the teaching of the nozzle 3 to the determination of a tip position and the actual coating. According to the above-described operations, since a tip position of each nozzle can be accurately calculated, dispersion of the object to be coated with a tip of the nozzle 3 can be suppressed, and the coating operation accurately controlled a coating position can be performed.

The kind of coating agents can be increased as much as the number of syringes 2 and nozzles 3 which can be attached to the rotary table 1. As for the determination of a tip position of the nozzle 3 and correction of the position, the above-described method may just be repeated for any nozzle 3, and it is possible to cope with many kinds of coating agents without complicating the structure and procedure.

In this embodiment, although it was described about a form, where the two pairs of thru-beam type sensors were arranged in such a way as the light axes thereof intersect an arc which becomes a locus of the nozzle 3 as illustrated in FIGS. 4A to 4C, the present invention is not limited to this form. As for the arrangement of the tip position determining units 5, the appropriate arrangement can be adopted for necessary positions in consideration of the constitution of an apparatus. The tip position determining units 5 can be properly selected from not only the above-described thru-beam type sensors but also an image recognition system using a camera, a method of using a touch sensor and the like considering a cost, a space, a takt time and the like.

In the present invention, although it is constituted that a plurality of syringes 2 are located at the rotary table 1, a tip position of the nozzle 3 connected to each syringe 2 can be accurately obtained. In addition, a tip position of the nozzle 3 can be specified by the movement carried out by only the one axis due to the rotation of the rotary table 1, and there is a large effect in realizing the space-saving. Therefore, it is required to control the coating position accurately, and, moreover, there is a large effect in a coating system of using plural kinds of coating agents.

The coating system 10 can perform accurate control and adjustment of a coating position by firstly performing an accurate determination of a tip position by including the above-described tip position determining unit 5 in this system. For example, a control of the coating position can be performed with accuracy of ten to several tens micrometers.

Next, a basic operation will be described as to the cleaning of a tip of the nozzle 3 to be connected to the syringe 2.

There is a case that the coating agent sometimes remains at the tip of the nozzle 3 after completing the coating. In this case, the residual coating agent is applied together with the coating agent in the next coating, and there occurs a case that the coating amount exceeds a predetermined amount. On the contrary, there occurs a case that the residual coating agent is hardened and a discharging operation is blocked and the discharging amount is reduced. Further, an accuracy of a coating position cannot also be exhibited because a tip shape of the nozzle 3 is changed by the residual coating agent. In order to prevent this situation, it is preferable to clean the nozzle 3 after completing the discharging operation.

As illustrated in FIG. 1, the cleaning unit 4 is equipped with the coating apparatus 11. As for the cleaning unit 4, an appropriate form is selected according to the kind of coating agent. However, in this embodiment, a method of cleaning the coating agent remained outside the nozzle 3 by the absorption using an air current will be described.

Figure 8:
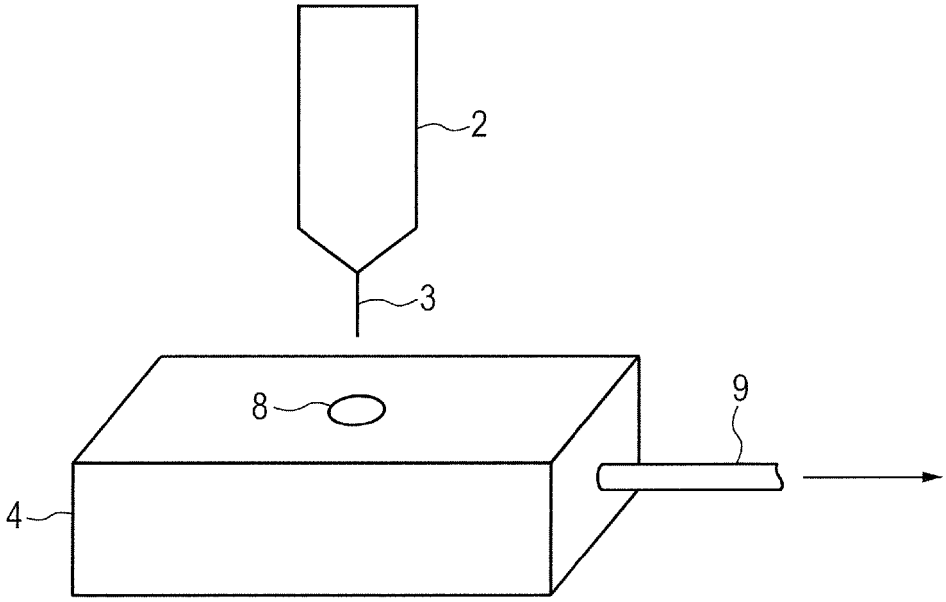
FIG. 8 is a schematic diagram for describing the cleaning unit.

As illustrated in FIG. 8, the cleaning unit 4 has a suction opening 8 and an induction pipe 9. A mechanism of the cleaning unit 4 is that air is absorbed from the suction opening 8 by absorbing air from the induction pipe 9 and the residual coating agent remained at the tip of the nozzle 3 is eliminated by the absorbing air. The cleaning unit 4 is provided in such a state that the suction opening 8 is positioned opposite to the tip of the nozzle 3, which moved to such a position deviated from a position opposite to a coating position and moreover that the suction opening 8 can move back and forth to the opposite nozzle 3.

It will be described about a basic cleaning flow.

When the coating operation is completed, the nozzle 3 is moved to such a position, which is just above the suction opening 8, by rotating the rotary table 1. It is preferable that the position information about a position, where the cleaning unit 4 is arranged, is previously accumulated in the control unit 12.

Next, an absorbing operation is started by absorbing air from the induction pipe 9. As illustrated in FIG. 5, the cleaning unit 4 is lifted while performing the absorbing operation from the induction pipe 9 and then the tip of the nozzle 3 is completely inserted in the suction opening 8. After maintaining this state for a predetermined time, the cleaning unit 4 is dropped and then the nozzle 3 is pulled out. Thereafter, the absorbing operation being performed form the induction pipe 9 is stopped.

According to this series of operations, the tip of the nozzle 3 is always cleaned and the dispersion of coating amount can be suppressed. That is, a tip shape of the nozzle 3 is not changed by cleaning the tip of the nozzle 3 and the coating agent can be always discharged to a constant position. Accordingly, the coating agent can be applied with a high-definition condition.

A timing of the absorption performed from the induction pipe 9 is not limited to the above-described timing. It is allowed that the absorbing operation is started after the tip of the nozzle 3 is completely inserted in the suction opening 8, and further, it is allowed that the absorbing operation is previously stopped and then the nozzle is pulled out by dropping the cleaning unit 4 when completing the absorbing operation.

A cleaning method is not also limited to this absorption method, and a method, where the residual coating agent remained at the tip of the nozzle 3 is eliminated by, for example, the ultrasonic cleaning by filling the solvent into the cleaning unit 4, is also available. Furthermore, a method, where the residual coating agent is infiltrated into a sponge by contacting the tip of the nozzle 3 with the sponge by preparing a water-absorbable sponge and the residual coating agent is eliminated, is also available.

At any rate, plural kinds of coating agents can be efficiently cleaned with a space-saving state by combining the rotary table 1 and the movable cleaning unit 4, and there is a large effect in performing an accurate control of the coating amount and realizing a space-saving state.

As described above, the present invention can provide a coating system characterized in that an accurate control of a coating position and the cleaning of a nozzle used for the coating can be easily carried out in a single robot cell in case of performing a coating operation to a plurality of portions for a one component. In the present invention, syringes filled with different coating agents and nozzles connected to the respective syringes are not separately located by distributing to separate coating apparatuses but collectively arranged at one coating apparatus by locating at a rotary table. Since the syringe filled with a necessary coating agent and the nozzle connected to that syringe can be selected by the rotational movement associated with the rotation of the rotary table, a plurality of coating agents can be applied by the one coating apparatus and the one robot without moving an object to be coated on a large scale. For this reason, a takt time can be shortened and a space-saving state can be realized.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-009292, filed Jan. 22, 2013, which is hereby incorporated by reference herein in its entirety.

What is claimed is:

1. A coating system comprising:

a plurality of syringes respectively filled with different coating agents;

a plurality of nozzles, each one of the plurality of nozzles being connected to a corresponding one of the plurality of syringes and configured to discharge the coating agent of the connected syringe;

a rotary table for rotationally moving the plurality of syringes;

a robot configured to move an object to be coated, held by a robot hand, to a coating position; and a control unit configured to control the robot, wherein the sensor includes a beam which points in a direction intersecting a rotation axis of the rotary table, wherein the sensor measures the position of each nozzle by moving the rotary table such that each nozzle intersects the beam, and wherein the control unit performs control for moving the object to be coated, held by the robot hand, to the coating position, the coating position being a position to which a nozzle is oppositely located.

2. The coating system according to claim 1, further comprising a cleaning unit configured to clean the nozzle from which the coating agent was discharged.

3. The coating system according to claim 2, wherein the cleaning unit comprises a suction opening for sucking and removing the coating agent remaining outside the nozzle.

4. The coating system according to claim 3, wherein the cleaning unit is provided such that the suction opening is positioned to face a tip of the nozzle rotationally moved from a position facing the coating position, and the suction opening can advance to and retreat from the nozzle that the suction opening faces.

5. The coating system according to claim 4, wherein the sensor comprises two pairs of sensors, each pair symmetrically provided with respect to a rotational path of the plurality of nozzles, for measuring the positions of the respective tips of the plurality of nozzles, and wherein the two pairs of sensors are provided on the cleaning unit.

6. The coating system according to claim 2, wherein the sensor is provided on the cleaning unit.

7. The coating system according to claim 1, wherein the sensor comprises two pairs of sensors, each pair symmetrically provided with respect to a rotational path of the plurality of nozzles, for measuring the positions of the respective tips of the plurality of nozzles.

8. The coating system according to claim 7, wherein a through-beam type sensor, which constitutes the sensor, can be moved in a rotation axis direction of the rotary table.

9. The coating system according to claim 8, wherein the rotary table rotationally moves a nozzle such that the tip of the nozzle intersects the beam.

10. The coating system according to claim 1, wherein the robot includes an articulated robot, and the robot hand is a part of the articulated robot.

11. The coating system according to claim 1, wherein the robot hand can change a position of the object to be coated, in a state that the object to be coated has been moved to the coating position.

12. The coating system according to claim 1, wherein the control unit performs the control for moving the object to be coated held by the robot hand to the coating position, while performing the control for selecting the syringe filled with the coating agent to be applied to the object to be coated and moving the nozzle connected to the selected syringe to the position facing the coating position by the rotation of the rotary table.

13. The coating system according to claim 1, wherein the control unit performs control for selecting the syringe filled with the coating agent to be applied to the object to be coated, and moving the nozzle connected to the selected syringe to a position facing the coating position by the rotation of the rotary table, and performs control for discharging the coating agent from the nozzle.

14. A coating system comprising:

a plurality of syringes respectively filled with different coating agents;

a plurality of nozzles, each one of the plurality of nozzles being connected to a corresponding one of the plurality of syringes and configured to discharge the coating agent of the connected syringe;

a rotary table for rotationally moving the plurality of syringes;

a robot configured to move an object to be coated, held by a robot hand, to a coating position;

a sensor; and a control unit configured to control the robot, wherein the plurality of nozzles includes a teaching nozzle, and wherein the control unit performs control for moving the object to be coated, held by the robot hand, to the coating position, the coating position being a position corrected based on a difference between a tip of the teaching nozzle and a tip of one of the plurality of nozzles obtained from values measured by the sensor.

15. The coating system according to claim 14, wherein the sensor comprises two pairs of sensors, each pair symmetrically provided with respect to a rotational path of the plurality of nozzles, for measuring the positions of the respective tips of the plurality of nozzles.

16. The coating system according to claim 15, wherein a through-beam type sensor, which constitutes the sensor, can be moved in a rotation axis direction of the rotary table.

17. The coating system according to claim 16, wherein the rotary table rotationally moves a nozzle such that the tip of the nozzle intersects a beam of the through-beam type sensor.

* * * * *